US010014147B2

(12) United States Patent
Matsumoto et al.

(10) Patent No.: US 10,014,147 B2
(45) **Date of Patent: *Jul. 3, 2018**

(54) X-RAY TUBE

(71) Applicants: Futaba Corporation, Chiba (JP); Hamamatsu Photonics Kabushiki Kaisha, Shizouka (JP)

(72) Inventors: Akira Matsumoto, Chiba (JP); Kiyoyuki Deguchi, Chiba (JP); Yuuichi Kogure, Chiba (JP); Kazuhito Nakamura, Chiba (JP); Tomoyuki Okada, Shizuoka (JP); Toru Fujita, Shizuoka (JP); Tatsuya Nakamura, Shizuoka (JP)

(73) Assignee: FUTABA CORPORATION, Chiba (JP)

( * ) Notice: Subject to any disclaimer, the term of this patent is extended or adjusted under 35 U.S.C. 154(b) by 723 days.

This patent is subject to a terminal disclaimer.

(21) Appl. No.: 14/469,724

(22) Filed: Aug. 27, 2014

(65) Prior Publication Data

US 2014/0362976 A1 Dec. 11, 2014

Related U.S. Application Data

(63) Continuation of application No. PCT/JP2013/055698, filed on Mar. 1, 2013.

(30) Foreign Application Priority Data

Mar. 5, 2012 (JP) ..... 2012-048066

(51) Int. Cl.
*H01J 35/04* (2006.01)
*H01J 35/06* (2006.01)
(Continued)

(52) U.S. Cl.
CPC ..... *H01J 35/045* (2013.01); *H01J 35/04* (2013.01); *H01J 35/06* (2013.01); *H01J 35/16* (2013.01);
(Continued)

(58) Field of Classification Search
CPC ..... H01J 2235/087; H01J 2235/186; H01J 35/04; H01J 35/045; H01J 35/06; H01J 35/16; H01J 35/18
See application file for complete search history.

(56) References Cited

U.S. PATENT DOCUMENTS 6,118,852 A 9/2000 Rogers et al.
9,008,276 B2 * 4/2015 Matsumoto ..... H01J 35/06 378/140
(Continued)

FOREIGN PATENT DOCUMENTS

JP H08264139 A 10/1996
JP H0945492 A 2/1997
(Continued)

OTHER PUBLICATIONS

Translation of JP 09-045492, which was published on Feb. 14, 1997.*
(Continued)

*Primary Examiner* — Glen Kao
(74) *Attorney, Agent, or Firm* — Quarles & Brady LLP

(57) ABSTRACT

Provided is an X-ray tube which can perform stable X-ray radiation under a desired condition in a radiation region extending in a predetermined direction. Included are a base plate having an opening portion and made of alloy 426, an X-ray transmission window made of titanium foil and arranged to close the opening portion of the base plate, a flat box-like vessel portion attached to the base plate and inside of which is in a vacuum state, an X-ray target provided at the
(Continued)

opening portion in the vessel portion, and an electron source injecting electrons to the X-ray target in the vessel portion. The electron source includes a liner cathode, a first control electrode pulling out electrons from the cathode and a second control electrode restricting radiation range of the pulled-out electrons. At this time, X-rays emitted from the X-ray window spreads radially from opening shape of the opening portion.

7 Claims, 2 Drawing Sheets

(51) Int. Cl.
*H01J 35/18* (2006.01)
*H01J 35/16* (2006.01)

(52) U.S. Cl.
CPC ..... *H01J 35/18* (2013.01); *H01J 2235/087* (2013.01); *H01J 2235/186* (2013.01)

(56) References Cited

U.S. PATENT DOCUMENTS

2002/0085675 A1* 7/2002 Snyder ..... H01J 35/105 378/130
2008/0095317 A1* 4/2008 Lemaitre ..... H01J 35/04 378/138
2013/0034207 A1* 2/2013 Aoki ..... H01J 35/04 378/62

FOREIGN PATENT DOCUMENTS

| | | | |
|---|---|---|---|
| JP | 2000156188 | A | 6/2000 |
| JP | 2000306533 | A | 11/2000 |
| JP | 2002033080 | A | 1/2002 |
| JP | 2008288158 | A | 11/2008 |
| JP | 2009021032 | A | 1/2009 |
| TW | 200518155 | A | 6/2005 |
| TW | 201103062 | A | 1/2011 |
| WO | 2007135812 | A1 | 11/2007 |

OTHER PUBLICATIONS

Translation of JP 2002-033080, which was published on Jan. 31, 2002.*
PCT International Search Report, PCT/JP2013/055698, dated Apr. 2, 2013, 6 pages.
PCT International Preliminary Report on Patentability, PCT/JP2013/055698, dated Sep. 18, 2014, 14 pages.
Intellectual Property Office of the People's Republic of China, Examination Report, Application No. 102107583, Jun. 3, 2014, 10 pages.

* cited by examiner

X-RAY TUBE

CROSS-REFERENCE TO RELATED APPLICATIONS

This application is a Continuation Application of PCT International Application No. PCT/JP2013/055698 filed on Mar. 1, 2013, and claims the benefit of Japanese Patent Application No. 2012-048066 filed on Mar. 5, 2012.

The inventions claimed herein were made by or on behalf of Hamamatsu Photonics Kabushiki Kaisha and Futaba Corporation, who are parties to a joint research agreement that was in effect on or before the date the claimed invention was made. The claimed invention was made as the result of activities undertaken with the scope of the joint research agreement.

TECHNICAL FIELD

The present invention relates to an X-ray tube in which electrons are emitted from an electron source inside a package in a vacuum state and injected to an X-ray target, and X-rays produced from the X-ray target are emitted to outside through an X-ray transmission window of the package.

BACKGROUND ART

Patent Literature 1 mentioned below discloses a long X-ray tube extending in a predetermined direction. This X-ray tube houses a coiled filament inside of a long vacuum vessel and allows thermoelectrons from the filament to hit an anode which is a window, thereby producing X-rays and emitting them to outside.

CITATION LIST

Patent Literature

Patent Literature 1: Japan Patent Application Publication No. H10-39100

SUMMARY OF INVENTION

Technical Problem

However, the conventional X-ray tube disclosed in Patent Literature 1 has a drawback that, since an entire one side of the vacuum vessel is sealed by the window which also serves as the anode, the thickness of the window member needs to be large to obtain strength necessary for holding vacuum; however, the large thickness of the window member causes difficulty in emitting the produced X-rays to the outside. That is, it is difficult to achieve good balance between the vacuum holding ability and the X-ray emission ability. Furthermore, the emission of the electrons from the filament may not be homogeneous, and in this case the amount of X-rays emitted through the window will be inhomogeneous within a radiation region. Thus, it is difficult to perform stable X-ray radiation under a desired condition within the radiation region extending in the predetermined direction.

In view of the drawback mentioned above, an object of the present invention is to provide an X-ray tube which can perform stable X-ray radiation under a desired condition within a radiation region extending in a predetermined direction.

Solution to Problem

According to a first aspect of the present invention, an X-ray tube includes a base plate made of metal material and having an opening portion, an X-ray transmission window arranged so as to close the opening portion, a flat box-like vessel portion which is attached to the base plate and inside of which is in a vacuum state, an X-ray target provided to the opening portion at the inside of the vessel portion in close contact with the X-ray transmission window, and an electron source provided at the inside of the vessel portion and having at least a linear cathode extending so as to correspond to the opening portion of the base plate and a plurality of control electrodes having an opening corresponding to a longitudinal direction of the cathode, the electron source being configured to control electrons emitted from the cathode by the plurality of control electrodes and inject the electrons to the X-ray target, wherein X-rays emitted from the X-ray transmission window spreads radially from an opening shape of the opening portion.

According to a second aspect, there is provided the X-ray tube according to the first aspect, wherein the control electrodes include at least a first control electrode arranged between the cathode and the X-ray transmission window and a second control electrode arranged between the first control electrode and the X-ray transmission window, and wherein at least one of the first control electrode and the second control electrode is arranged so as to surround the cathode.

According to a third aspect, there is provided the X-ray tube according to the first or second aspect, wherein the second control electrode is arranged so as to surround the cathode and the first control electrode.

According to a fourth aspect, there is provided the X-ray tube according to the second or third aspect, wherein the electron source includes a back electrode formed on an inner face of the vessel portion so as to face the first control electrode.

According to a fifth aspect, there is provided the X-ray tube according to any one of the second to fourth aspects, wherein an opening of the second control electrode is narrower than an opening of the first control electrode.

According to a sixth aspect, there is provided the X-ray tube according to any one of the first to fifth aspects, wherein titanium is used for the X-ray transmission window.

According to a seventh aspect, there is provided the X-ray tube according to any one of the first to sixth aspects, wherein alloy 426 is used for the base plate.

According to an eighth aspect, there is provided the X-ray tube according to any one of the first to seventh aspects, wherein a grid-like or honeycomb-like mesh is formed at the respective openings of the control electrodes.

Advantageous Effect of Invention

According to the X-ray tube of the first aspect, the X-ray tube including the flat box-like vessel portion is provided with the base plate made of metal material and the X-ray transmission window arranged to close the opening portion of the base plate. Thus, a good balance between the vacuum holding ability and the X-ray radiation ability of the X-ray tube can be achieved. Furthermore, the electron source includes the linear cathode and the plurality of control electrodes, and the extending direction of the linear cathode and the opening of the control electrode correspond to the shape of the opening portion of the base plate. Thus, the X-rays can be taken-out homogeneously from substantially entire region of the opening portion of the base plate.

Consequently, X-ray radiation can be performed stably under a desired condition in the radiation region extending in a predetermined direction.

According to the X-ray tube of the second aspect, the control electrode includes the first control electrode and the second control electrode, and at least one of the first control electrode and the second control electrode is arranged so as to surround the linear cathode. Thus, the potential around the cathode can be stabilized, and the X-ray radiation can be performed stably under a desired condition.

According to the X-ray tube of the third aspect, the second control electrode is arranged so as to surround the cathode and the first control electrode. Thus, the potential around the cathode can be stabilized even more, and the X-ray radiation can be performed stably under a desired condition.

According to the X-ray tube of the fourth aspect, there is provided the back electrode formed on the inner face of the vessel portion so as to face the first control electrode. Thus, the electron injection to the inner face of the vessel portion facing the cathode can be restricted, and the potential around the cathode can be stabilized even more, thereby performing stable X-ray radiation under a desired condition.

According to the X-ray tube of the fifth aspect, the opening of the second control electrode is arranged narrower than the opening of the first control electrode. Thus, the electron take-out location can be restricted, and the emission location of the electrons from the second control electrode can be restricted such that the electrons are focused on the X-ray target. Consequently, the electrons can be prevented from hitting an undesired area of the base plate, and the X-ray radiation can be performed stably under a desired condition.

According to the X-ray tube of the sixth aspect, material which produces toxicity such as beryllium is not used for the X-ray transmission window, providing safety.

According to the X-ray tube of the seventh aspect, the strength of the base plate can be improved. Especially, it is difficult to provide strength to the base plate due to the opening portion formed on the base plate; however, by using the alloy 426, the base plate can be provided with sufficient strength despite the opening portion.

According to the X-ray tube of the eighth aspect, the openings of the control electrodes include the grid-like or honeycomb-like mesh, thereby improving the strength of the control electrode and stabilizing the potential within the electron source.

DESCRIPTION OF EMBODIMENTS

Figure 1:
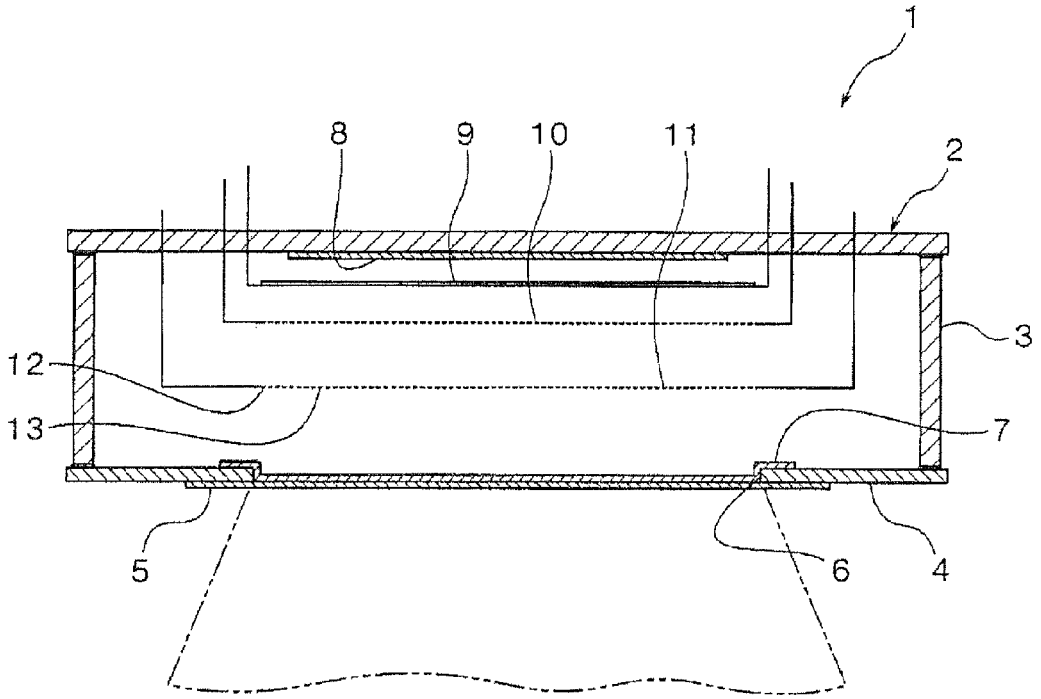
FIG. 1 is a cross-sectional view of an embodiment of the present invention.
Figure 2:
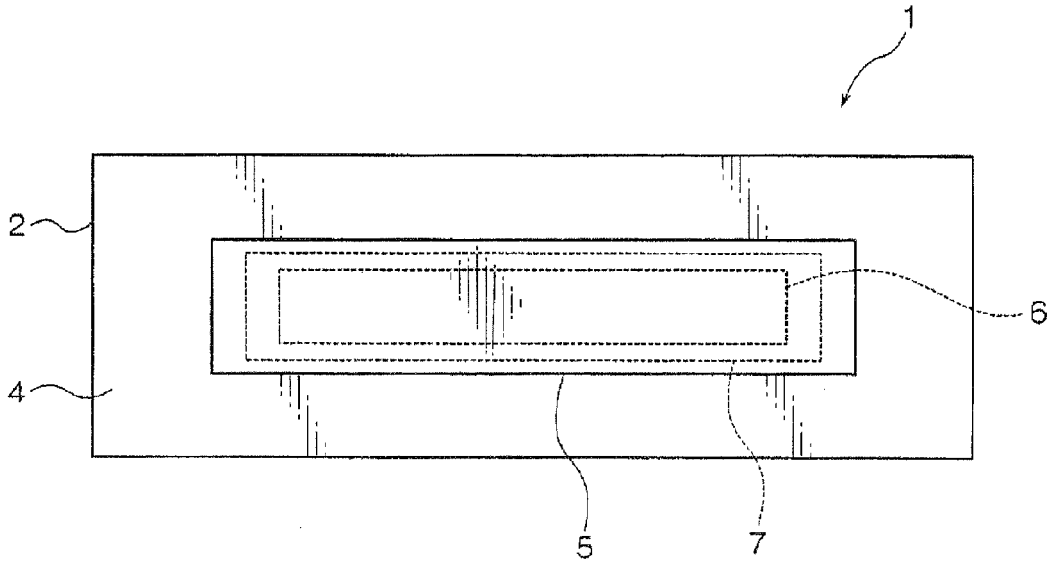
FIG. 2 is a front view of the embodiment of the present invention.
Figure 3:
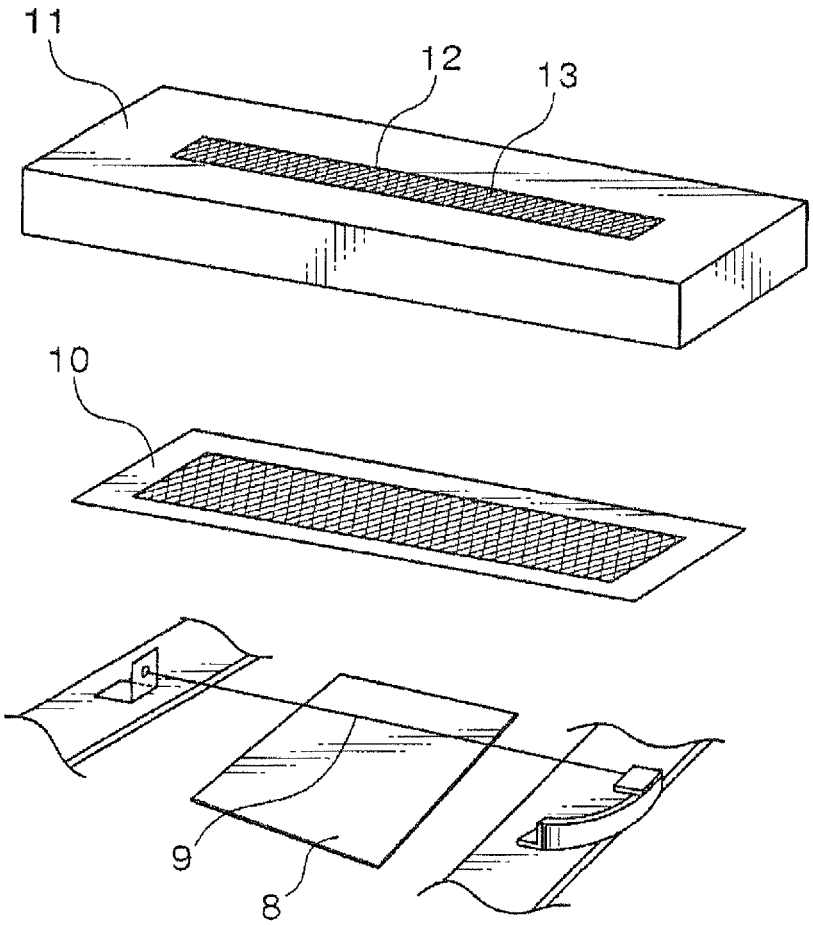
FIG. 3 is an exploded and separated perspective view illustrating an electrode structure of the embodiment of the present invention.

One embodiment of the present invention is explained in reference to FIGS. 1-3. As shown in FIG. 1, an X-ray tube 1 includes a flat box-like package 2 as a main body. This package 2 includes a vessel portion 3 formed into a flat box-like shape by a glass plate, a base plate 4 attached to an open-side peripheral portion of the vessel portion 3 so as to seal the vessel portion 3, and a later-described X-ray transmission window 5 provided to the base plate 4. Inside of the package 2 is evacuated in a vacuum state. The base plate 4 is a rectangular plate made of alloy 426. The alloy 426 is alloy made of 42% Ni, 6% Cr and remnant including Fe and such, and has substantially the same coefficient of thermal expansion as a soda lime glass forming the vessel portion 3.

In the case where the material of the vessel portion 3 is a glass plate other than a soda lime glass, then the above-mentioned base plate 4 may be a metal plate made of other materials so that the coefficient of thermal expansion of the base plate 4 is substantially the same as the vessel portion 3.

As shown in FIG. 2, the base plate 4 includes an elongated, rectangular opening portion 6 formed at a center of the base plate 4 in a longitudinal direction. Although in the shown example the opening portion 6 has an oblong rectangular shape, it may be formed into a thinner slit-like shape.

As shown in FIG. 1, the X-ray transmission window 5 is provided at one face (i.e. a face located at an outer side of the package 2) of the base plate 4 so as to close the opening portion 6. A titanium foil is used for the X-ray transmission window 5. Titanium is suitable material for the X-ray transmission window 5, because it does not produce toxicity like beryllium does and it has good radiolucency.

As shown in FIG. 1, the base plate 4 includes an X-ray target 7 provided at the opening portion 6 at another face (i.e. a face located at an inner side of the package 2) of the base plate 4 located inside the vessel portion 3. The X-ray target 7 is made of a tungsten film closely-attached, by vapor deposition, on an inner face of the X-ray transmission window 5 from the inner side of the opening portion 6. For the X-ray target 7, metals other than tungsten such as molybdenum may be used.

As shown in FIGS. 1 and 3, a back electrode 8 for prevention of electrification due to the electron injection to the glass is provided inside of the vessel portion 3, i.e. inside of the package 2, and at an inner face facing the X-ray transmission window 5. A linear cathode 9 for supplying electrons to be injected to the X-ray target 7 extends under (i.e. at an X-ray transmission window 5 side of) the back electrode 8. A control electrode (a first control electrode 10) for pulling out the electrons from the cathode 9 is provided between the cathode 9 and the X-ray transmission window 5, and a control electrode (second control electrode 11) for accelerating the electrons pulled out by the first control electrode is provided between the first control electrode 10 and the X-ray transmission window 5.

The linear cathode 9 is formed by providing carbonate on a surface of a core wire made of tungsten and such, and it emits thermoelectrons by electrically heating the core wire. The back electrode 8 is a plate-like electrode arranged to face the first control electrode 10 across the linear cathode 9.

Furthermore, the first control electrode 10 and the second control electrode 11 are electrodes having a flat face portion extending so as to face the linear cathode 9, and said flat face portion includes a mesh-like opening at a location corresponding to the cathode 9. More specifically, the first control electrode 10 is a control electrode which directly faces the cathode 9, and the flat face portion thereof having the mesh-like opening covers an area wider than the linear cathode 9 when seen from the X-ray transmission window 5. On the other hand, the second control electrode 11 includes a slit-like opening 12 which is located at its flat face portion corresponding to the linear cathode 9 and which extends along a longitudinal direction and has a mesh 13. The size of the opening 12 is narrower than the opening of the first control electrode 10 (i.e. the size of the opening 12 falls within the opening of the first control electrode 10 when seen from the X-ray transmission window 5). The opening 12 and the mesh 13 of the second control electrode 11 are arranged to correspond with the opening portion 6 of the above-mentioned base plate 4 and the X-ray target 7 provided near the opening portion and to restrict an area in which the electrons emitted from the cathode 9 are radiated. And, by applying the electrons to the X-ray target 7, X-rays are generated efficiently and emitted to the outside of the package 2. Furthermore, the second control electrode 11 includes side wall portions extending substantially perpendicularly from the flat face portion thereof toward a flat face of the vessel portion 3 located on the cathode 9 side, thus the second control electrode 11 has a box-like shape in which its four sides are surrounded by plates. Thus, the back electrode 8, the cathode 9 and the first control electrode 10 are surrounded by and housed in the second control electrode 11.

An electron source is constituted by the back electrode 8, the cathode 9, the first control electrode 10 and the second control electrode 11. Therefore, the cathode 9 is surrounded by the electrode applied with predetermined potential, thus the cathode 9 is not influenced by the electrification at the inner face of the vessel portion 3, thereby stabilizing the potential around the cathode 9.

Furthermore, the second control electrode 11 surrounds and houses the back electron 8, the cathode 9 and the first control electrode 10 in an internal space of the second control electrode 11, thereby preventing the electrification at the inner face of the vessel portion 3 caused by the electrons pulled out from the cathode 9 by the first control electrode 10 being injected to the locations other than the X-ray target 7, such as the inner face of the vessel portion 3.

The back electrode 8 may be omitted as long as there is sufficient distance between the vessel portion 3 and the linear cathode 9 and the influence of the electrification due to the electron injection to the vessel portion 3 is small. Furthermore, in addition to the first control electrode 10 and the second control electrode 11, another control electrode may be added in accordance with the distance between the linear cathode 9 and the X-ray target 7, the tube potential or the degree of focusing of the X-rays emitted from the X-ray transmission window 5.

Furthermore, as in the case of the base plate 4, for the first control electrode 10 and the second control electrode 11, it is preferable to use the alloy 426 to provide substantially the same coefficient of thermal expansion as the vessel portion 3.

According to the X-ray tube 1 of the above-mentioned embodiment, the radiation region of the electrons pulled out from the cathode 9 by the first control electrode 10 is restricted to the vicinity of the X-ray target 7 by the electric field of the second control electrode 11, and the electrons are injected to the X-ray target 7 and generate X-rays, and these X-rays are emitted from the X-ray transmission window 5 which is restricted by the opening portion 6 of the base plate 4. At this time, as shown in FIG. 1 by a two-dot line, the X-rays are emitted from the X-ray window 5 in a radially-spreading fashion from the opening shape of the opening portion 6. That is, the radiation range of the X-rays is widely spread, and if the opening portion 6 has an oblong rectangular shape then the radiation becomes planar, as shown in FIG. 2. Therefore, this X-ray tube 1 can be preferably used for the purpose of, for example, radiating the X-rays to air and such to generate ionized gas and performing neutralization of a charged, to-be-neutralized object using this gas.

Furthermore, by forming the opening portion 6 into a desired size and shape, a desired X-ray radiation region can be formed and also, when using for the purpose of X-ray radiation for resolving the electrification, the radiation region corresponding to a size of an object and a range can be set easily with a relatively high degree of freedom.

The X-ray tube 1 according to the embodiment explained above are described as for the application of neutralization by radiating the X-rays to an object; however, the present invention is not limited to this application and may be used for other applications such as sterilization.

[List of Reference Signs]

1 X-ray tube
3 vessel portion
4 base plate
5 X-ray transmission window
6 opening
7 X-ray target
9 cathode
10 control electrode (first control electrode)
11 control electrode (second control electrode)

The invention claimed is:

1. An X-ray tube comprising:

a base plate made of metal material and having an opening portion;

an X-ray transmission window arranged so as to close the opening portion;

a flat box-like vessel portion which is attached to the base plate and inside of which is in a vacuum state;

an X-ray target provided to the opening portion at the inside of the vessel portion in close contact with the X-ray transmission window; and an electron source provided at the inside of the vessel portion and having at least a linear cathode extending so as to correspond to the opening portion of the base plate and a plurality of control electrodes having an opening corresponding to a longitudinal direction of the cathode, the electron source being configured to control electrons emitted from the cathode by the plurality of control electrodes and inject the electrons to the X-ray target, wherein X-rays emitted from the X-ray transmission window spread radially from an opening shape of the opening portion, wherein the control electrodes include at least a first control electrode arranged between the cathode and the X-ray transmission window and a second control electrode arranged between the first control electrode and the X-ray transmission window, and wherein the opening of the second control electrode is narrower than the opening of the first control electrode.

2. The X-ray tube according to claim 1, wherein at least one of the first control electrode and the second control electrode is arranged so as to surround the cathode.

3. The X-ray tube according to claim 2, wherein the second control electrode is arranged so as to surround the cathode and the first control electrode.

4. The X-ray tube according to claim 2, wherein the electron source includes a back electrode formed on an inner face of the vessel portion so as to face the first control electrode.

5. The X-ray tube according to claim 1, wherein titanium is used for the X-ray transmission window.

6. The X-ray tube according to claim 1, wherein alloy 426 is used for the base plate.

7. The X-ray tube according to claim 1, wherein a grid-like or honeycomb-like mesh is formed at the respective openings of the control electrodes.

* * * * *